US005492069A

United States Patent [19]

Alexander et al.

[11] Patent Number: 5,492,069

[45] Date of Patent: Feb. 20, 1996

[54] PALLET ASSEMBLY

[75] Inventors: Samuel R. Alexander; Sarah R. Alexander; Gaylord A. Hiler, all of Diamondhead, Miss.

[73] Assignee: E. I. Du Pont de Nemours and Company, Wilmington, Del.

[21] Appl. No.: 276,577

[22] Filed: Jul. 18, 1994

[51] Int. Cl.[6] ..... B65D 19/32

[52] U.S. Cl. ..... 108/56.3; 108/53.3; 108/901

[58] Field of Search ..... 108/56.3, 51.1, 108/901, 56.1, 52.1, 53.3

[56] References Cited

U.S. PATENT DOCUMENTS

| | | | |
|---|---|---|---|
| 2,463,214 | 3/1949 | Stoner | 108/51.1 |
| 3,342,146 | 9/1967 | Lessheim | 108/53.3 |
| 3,691,964 | 9/1972 | Larson et al. | 108/56.3 |
| 3,826,205 | 7/1974 | Weiss | 108/51.1 |
| 3,857,342 | 12/1974 | Johns | 108/56.1 X |
| 4,060,037 | 11/1977 | Gustafsson | 108/51.1 |
| 4,384,531 | 5/1983 | Spurgeon | 108/51.1 |
| 4,735,154 | 4/1988 | Hemery | 108/51.1 X |
| 4,843,976 | 7/1989 | Pigott et al. . | |
| 5,007,352 | 4/1991 | Calkoch | 108/56.1 |
| 5,046,434 | 9/1991 | Breezer et al. . | |
| 5,057,350 | 10/1991 | Gezels . | |
| 5,094,175 | 3/1992 | Christie . | |
| 5,097,951 | 3/1992 | Pigott et al. . | |
| 5,123,359 | 6/1992 | DelBalso . | |
| 5,160,029 | 11/1992 | Pigott et al. . | |
| 5,170,722 | 12/1992 | Friesner et al. . | |
| 5,197,396 | 3/1993 | Breezer et al. . | |
| 5,351,628 | 10/1994 | Breezer et al. | 108/51.1 X |

FOREIGN PATENT DOCUMENTS

| | | | |
|---|---|---|---|
| 2303124 | 7/1974 | Germany | 108/51.1 |
| 2214485 | 9/1989 | United Kingdom | 108/51.1 |
| 9113810 | 9/1991 | WIPO | 108/901 |
| 4022728 | 10/1994 | WIPO | 108/52.1 |

*Primary Examiner*—Laurie K. Cranmer
*Assistant Examiner*—Janet M. Wilkens

[57] ABSTRACT

A modular shipping pallet assembly which may be disassembled to smaller volume for shipping, reassembly and reuse. All of the components of the assembly are injection molded from recyclable or recycled thermoplastic polymers.

17 Claims, 4 Drawing Sheets

Fig. 2
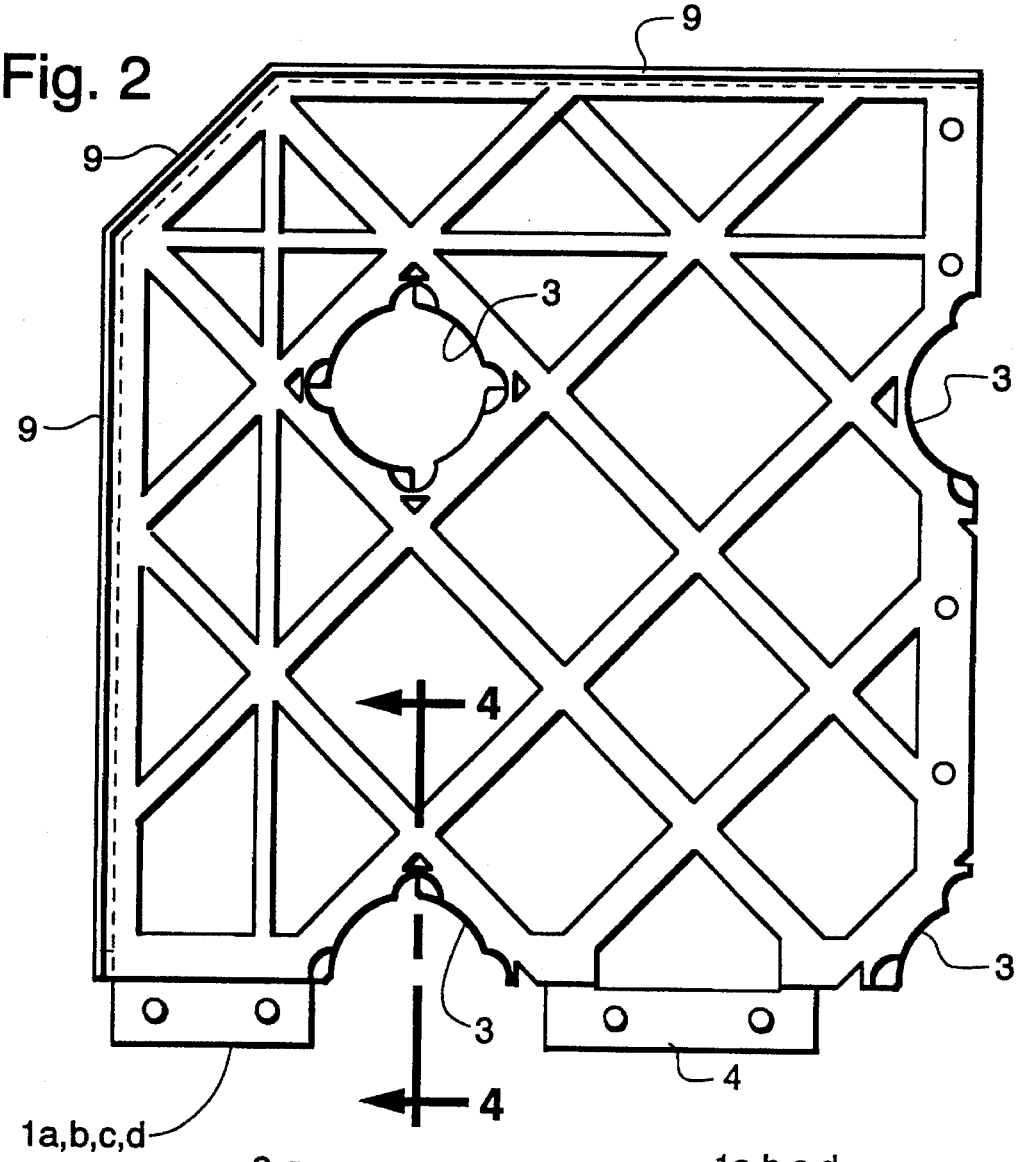
Fig. 3
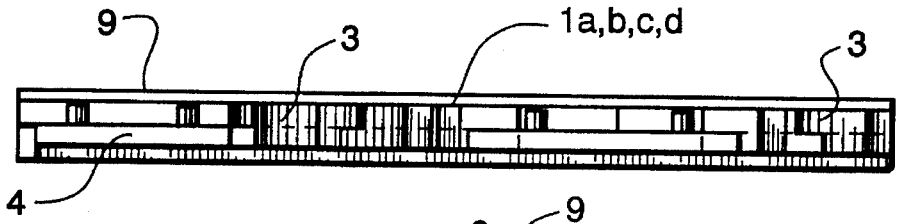
Fig, 4
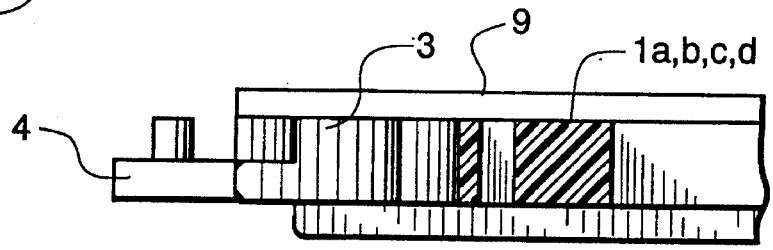

PALLET ASSEMBLY

FIELD OF INVENTION

The invention is directed to a shipping pallet assembly which may be disassembled to smaller volume for shipping, reassembly and reuse and which is made entirely from recyclable or recycled polymers.

BACKGROUND OF THE INVENTION

Wooden pallets have for many years been the primary method for unitizing freight for mechanical handling during shipment and storage. While they are effective for this purpose and reasonable in cost, they nevertheless present significant problems with respect to compliance with many shipping and environmental regulations. For example OSHA regulations state that a person should not lift over 50 pounds, but most wooden pallets weigh on the order of 65–80 pounds. Moreover, when they are stored outdoors they tend to pick up even more weight by adsorption of water. In addition, many countries require that wooden pallets be fumigated before entry.

In addition, wooden pallets create a space problem when shipping and storage space are critical because they cannot usually be disassembled for reuse and their typical thickness of six to nine inches causes a substantial reduction in useful capacity.

Wooden pallets also present a substantial safety and sanitation problem. A major safety problem is flammability of the wood from which they are made. Thus, wooden pallets in storage can create an intense fire if they are ignited which, in some circumstances, may be sufficient to overwhelm conventional sprinkler systems. Also, wooden pallets often have sharp edges, splinters and protruding nails which tend to damage product and frequently cause injury to personnel handling the pallets.

Wooden pallets too often become a health problem because they become infested with insects, birds and rodents. Moreover, because they can't be cleaned effectively with steam, they are subject to mildew and mold contamination. In addition, wooden pallets degrade rapidly in normal atmospheric exposure. Therefore, they can be reused only limitedly.

Structurally, wooden pallets suffer from other disadvantages. For example, conventional wooden pallet construction (see FIG. 8) does not allow four-way entry. They also have sharp edges and nails which are likely to damage product packaging, thus, requiring the use of cardboard covers (slip sheets). As mentioned above, a serious disadvantage is that they cannot be disassembled for volume reduction when they are shipped for reuse.

While it has been proposed that some of the disadvantages of wood pallet construction might be eliminated by the use of plastics, such attempts have been less economical than wood. For example, to make a monolithic molded pallet would involve a very high cost for making the mold. Furthermore, a one-piece pallet of this type could not be disassembled for reuse.

Recent efforts in this regard are illustrated by the following listed prior art patents, which are summarized below:

SUMMARY OF THE PRIOR ART

U.S. Pat. No. 4,843,976 to Pigott et al. is directed to a plastic pallet comprising a pair of identical frames having a plurality of spaced openings, the frame members being interconnected with circular hollow core connectors. Each connector includes a central core and a surrounding sleeve interconnected by spokes. The core has flexible tangs that extend beyond opposite ends of the sleeve and fit into and releasably interconnect through the openings in the frame members.

U.S. Pat. No. 5,046,434 to Breezer et al. is directed to a plastic reinforced unitary plastic pallet comprising a planar upper load-bearing sheet and a parallel lower sheet in which feet are formed by a plurality of concave depressions in the two sheets. The thusly formed sheets are reinforced with plastic fused to the feet between the upper and lower sheets. The load-bearing sheet has a peripheral lip. The pallet is formed from thermoplastic, which is indicated to be recyclable, high density polyethylene being preferred. The pallet is formed by a thermoforming process in which the two plastic sheets are vacuum molded.

U.S. Pat. No. 5,057,350 to Gezels is directed to a pallet formed from at least two types of polymeric material. In particular, the pallet is formed from a dense polymeric outer layer filled with a foamed inner layer which has been injected after the outer layer is formed. No particular polymers are named though claims are directed to a pallet in which the outer layer is a copolymer and the inner layer is a homopolymer.

U.S. Pat. No. 5,094,175 to Christie is directed to a modular pallet formed from a pair of upper and lower pallet sections, each of which includes a plurality of separate units which can be formed by molding recycled or recyclable plastics. The upper pallet section has four similar rectangular sections which include a flat grid-like base element and a plurality of downwardly facing cup-like connectors. The lower pallet section is comprised of a pair of rectangular major units having a plurality of upwardly facing cup-like connectors which interlock by telescopic engagement with the downwardly facing connectors on the upper layer. After assembly, the interlocked parts are deformed to prevent accidental separation.

U.S. Pat. No. 5,123,359 to DelBalso is directed to a heavy duty pallet comprising a rigid internal reinforcing skeleton, a rigid non-shrinkable plastic sheet tightly covering the lower surface, open spaces, sides and ends of the skeleton, and a second plastic sheet covering the upper surface of the skeleton to form a flat load deck. The skeleton is made of wood or aluminum. A non-skid surface is indicated for the surface of the load deck.

U.S. Pat. No. 5,170,722 to Friesner et al. is directed to a pallet assembly consisting of two sets of interlocking runners. A first runner has an opening to receive a plurality of second runners and a second runner has slots which mate with the upper and lower members of the first runner to secure the second runners in position. Positioning of the second runners is accomplished by bosses on the slot surface of the first runner. The runners are indicated to be made of wood, metal or plastics, but in all cases must be flexible and elastic to achieve good fit between the slot and the surfaces of the second runner. Preferred materials of construction are thermoset and thermoplastic polymers. The use of recycled thermoplastic polymers is disclosed.

U.S. Pat. No. 5,197,396 to Breezer et al. is directed to a double deck plastic pallet comprising an upper deck formed from two sheets of thermoplastic fused together and reinforced with a metal sheet between the two sheets. The upper deck assembly is connected to a similar lower deck assembly by means of plurality of plastic polygonal posts extending there between. The decks are fastened together by bolts through the posts.

SUMMARY OF THE INVENTION

The invention is therefore directed to a shipping pallet assembly, which may be disassembled to smaller volume for shipping, reassembly and reuse, comprising a rigid substantially planar rectangular deck having an upper load surface and lower support surface, a plurality of detachable hollow cupped feet having a symmetrical cross section, the open end of which feet depend from and are attached to the deck through openings in the lower surface of the deck assembly in a centrally positioned symmetrical array of lines and columns, each line and column being comprised of at least three such feet in both the longitudinal and transverse directions of the array, the cupped end of each of the feet being linked both longitudinally and transversely by a pair of detachable rail members which extend over the entire length and width of the array, each detachable rail member comprising a rigid rail having a plurality of openings spaced along and at the ends thereof to match the number and spacing of the cupped feet within any line or column of the array, the openings being sized in such manner that the rails fit tightly over the perimeter of the cupped feet at or near the cupped end of each of the feet, the deck sections, feet and rail members all being formed by injection molding of a molten normally solid thermoplastic water resistant polymer.

In a preferred aspect the invention is directed to the above-described pallet assembly in which the deck is formed from rectangular interlocking sections having a substantially identical configuration.

BRIEF DESCRIPTION OF THE DRAWING

The Drawing consists of eight figures as follows:

FIG. 2 is a plan view of one modular section of the load deck of the pallet, four of which interlock to form the load deck;

FIG. 3 is a side elevational view of the load deck modular panel of FIG. 2;

FIG. 4 is an enlarged detail sectional view of a quarter panel taken along the line 4—4 of FIG. 2;

DETAILED DESCRIPTION OF THE INVENTION

The pallet assembly of the invention is directed toward solution of a number of problems commonly associated with conventional wooden pallets and prior art pallets made from various plastics:

(1) The pallet assembly can be disassembled and reassembled without special tools. A hammer and screwdriver are usually sufficient.

(2) The pallet assembly is comprised of a minimal number of separate parts. In the case of a typical 45×45 inch pallet, only sixteen separate parts are needed when the deck is molded as one piece and only nineteen separate parts when the deck is formed from modular sections.

(3) The pallet assembly is comprised of a minimal number of different parts. In the case of a typical 45×45 inch pallet, only four different parts are required. Thus, both molding costs and parts inventory costs are minimized.

(4) All of the component parts of the assembly, including the deck sections, can be relatively small in size by which both the capital cost and operating costs of the injection molding equipment are reduced.

(5) All of the component parts are easily formed by injection molding techniques. Therefore, only a single technology is involved in manufacturing the component parts of the pallet assembly.

(6) The component parts are designed to take up minimal space when the pallets are disassembled and the parts shipped.

(7) All of the parts can be made of a single recyclable polymer or polymer mixture. It is not necessary to use different polymers on different parts. Moreover, there are no metal parts. On the other hand, if desired, different parts of the pallet can be made from different polymers.

(8) The pallets can be fabricated from a wide variety of recyclable and/or recycled polymers which are available at low cost from a large number of sources.

(9) The pallet assembly is capable of being adapted to a wide range of pallet geometries, sizes and strength requirements.

(10) Though the pallet may initially cost more than conventional wooden pallets, it nevertheless becomes more economical in use because of its longer useful life, light weight, convenient disassembly for back shipment and very low maintenance requirements; and

(11) The pallet of the invention can be 20–50 pounds lighter than comparably sized wooden pallets.

Figure 1:
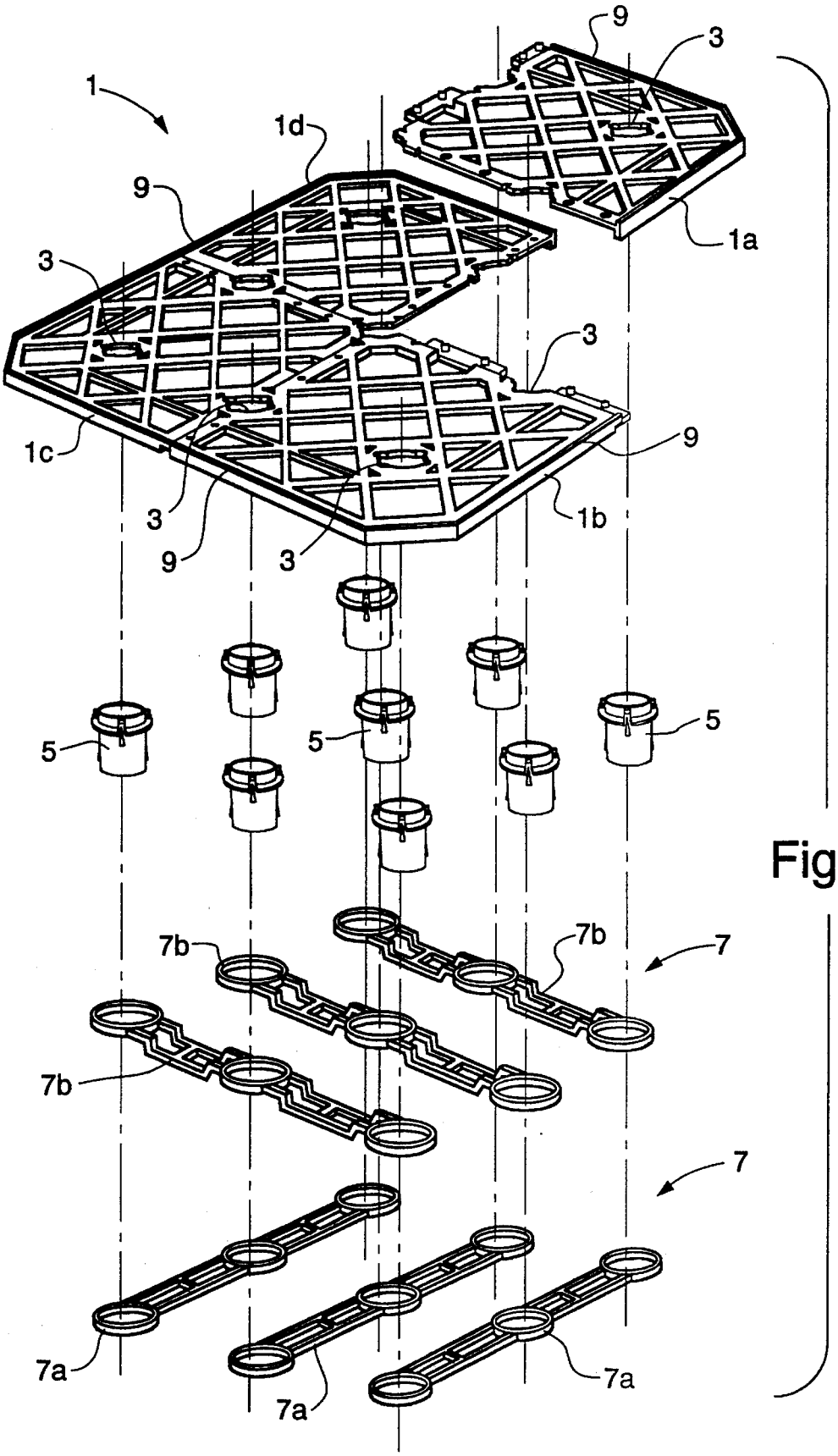
FIG. 1 is an exploded isometric view of the pallet of the invention.

Referring now to FIG. 1 of the Drawing, the pallet assembly of the invention is comprised of load deck 1, which is made up of four generally identical modular sections 1*a–d*, which are interlocked by lap joints along two edges. Each lap joint is interlocked by means of a plurality of bosses and matching recesses spaced along the matched surfaces of the lap joints. The deck 1 contains an array of nine circular openings 3, the circumferences of each of which has acceptor means to which a cupped foot 5 is attached by means of complementary insertion means. The cupped feet 5 are interlocked with the underside of the deck 1 through the circular openings 3, which are arranged in an array of three lines and transverse columns. As shown in the Figure, the modular deck sections are of generally square configuration in order that only a single section shape need be used. However, other generally rectangular shapes can be used to accommodate other pallet sizes and foot arrays. It will be recognized, however, that when more complex arrays are used for attachment of the cupped feet, more than one modular section will be required. For example, when a symmetrical array of sixteen feet is used, three different deck section configurations would be needed.

FIGS. 2–4 show in greater detail the configuration of the modular sections 1*a–d*. In particular, the figure shows the patterned openings in the sections by which the weight of the assembled pallet is substantially reduced. FIG. 3 also shows one method of interlocking the sections through the use of lap joints having bosses and holes. FIG. 4, which is a cross sectional view along lines 4—4 of FIG. 2, shows in detail the bossed flange 4 along one side of the modular section.

A unique feature of this best mode of the invention is that, by locating most of the foot attachment openings across the joints between two or more of the modular sections, the attachment of the cupped feet to the deck also serves to interlock the modular deck sections. In a typical square array of nine cupped feet, all but the four corner feet are preferably attached to foot attachment openings formed from two or more adjoining modular sections. In the preferred embodiment illustrated in FIG. 1, it can be seen that four of the attachment openings extend between two sections and the one in the center of the array extends between all four of the modular sections.

Figure 5:
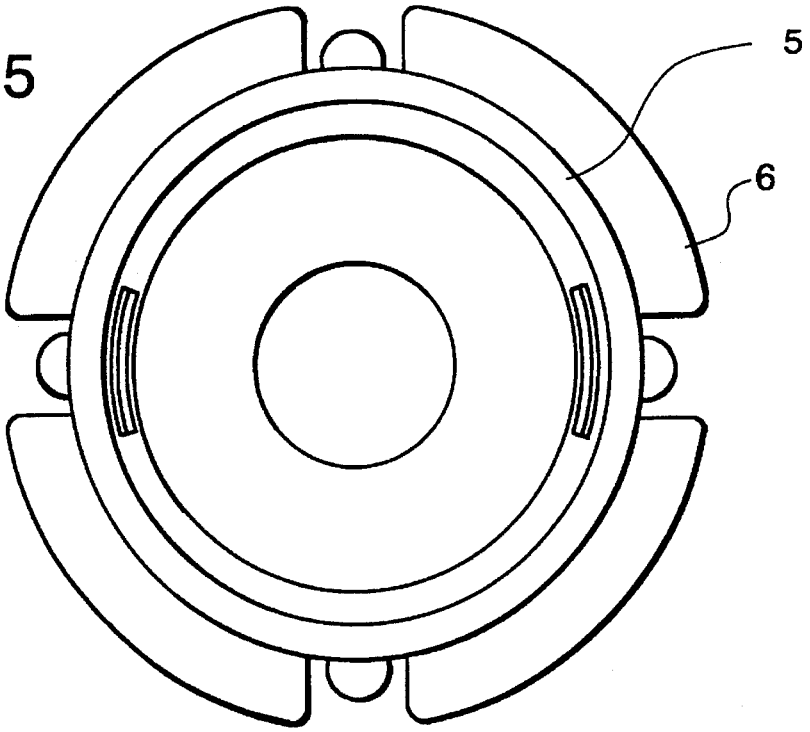
FIG. 5 is a plan view of one of the cupped feet.
Figure 6:
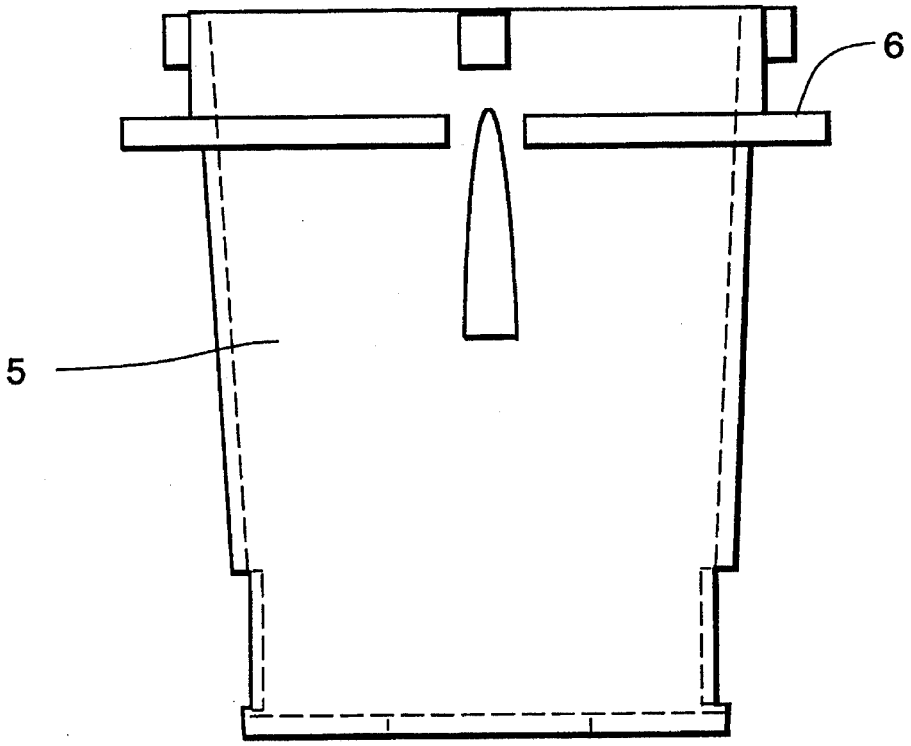
FIG. 6 is a side elevational view of the cupped foot of FIG. 5.

Preferably, the cupped feet 5 are circular in cross section, open at the top, but cupped at the bottom in order to get broader weight distribution. In a preferred embodiment, the outside perimeter of the upper end of the cupped foot 5 is molded in the form of a bayonet-type connection which inserts in a corresponding acceptor recess molded on the perimeter of the circular openings 3. Though the above-described arrangement is preferred, the interlocking device can also be reversed. That is, the circumference of the circular opening 3 can be extended in the form of a lip, the outside of which is molded in the form of a bayonet-type connection and the inside of the cupped foot 5 can be molded in the form of a recess to accept the bayonet-type insert. FIG. 5 is a plan view of the top of the cupped feet 5 showing a preferred interlocking mechanism for attaching the cupped feet 5 to the modular sections 1*a–d* through the holes 3 therein. FIG. 6 is an elevational view of a preferred cupped foot configuration in which the cupped foot 5 is inserted through opening 3, positioned by flange 6 and snaps into place. Other interlocking devices such as screw-type connections can be used as well. The thickness of the walls of the cupped feet 5 is chosen in accordance with the loads which the pallets are anticipated to bear. The cupped feet 5 are preferably tapered toward the bottom to facilitate positioning of the rails thereon by pressure fitting and to enable nesting of the cupped feet when the pallet is dismantled. In addition, it is preferred that cupped feet 5 be open on the bottom to allow drainage of any liquid that might otherwise accumulate during outdoor storage.

Figure 7:
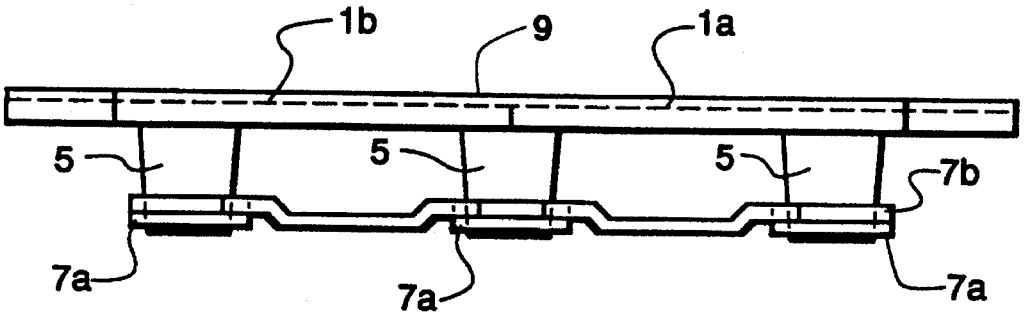
FIG. 7 is a side elevational view of a completely assembled pallet according to the invention.
Figure 8:
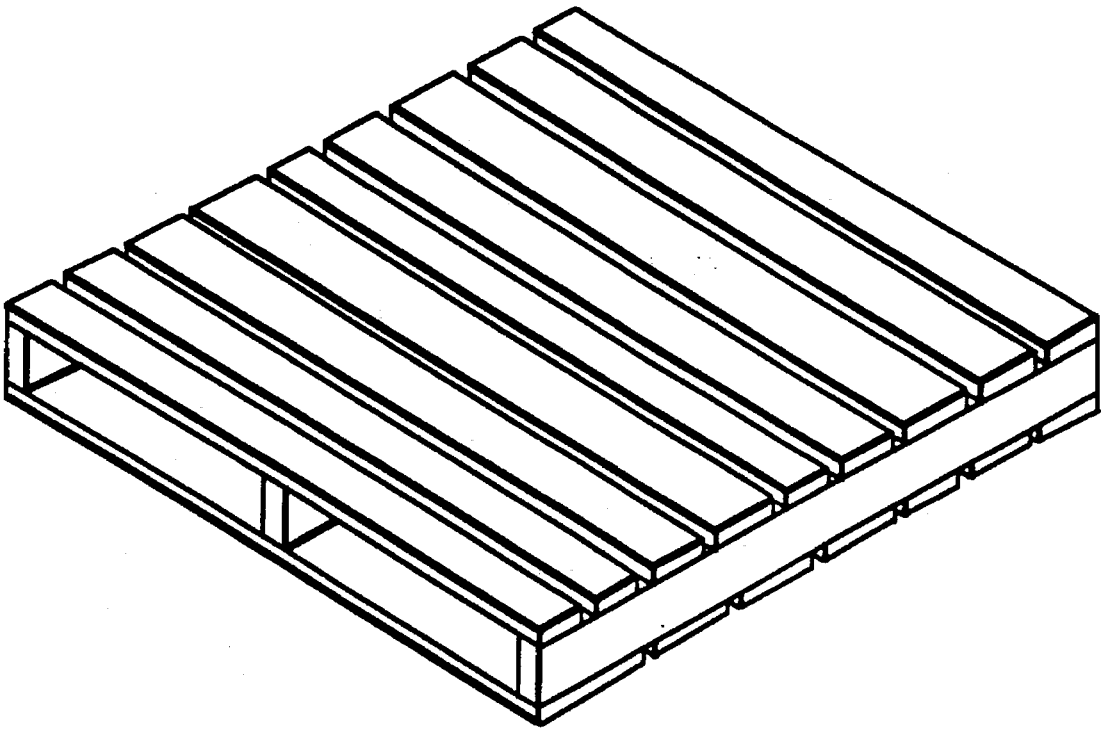
Fig. 8 PRIOR ART
FIG. 8 is a perspective view of a typical prior art wooden pallet.

Referring now to FIG. 7, each line and column of the cupped feet 5 in the array is connected both longitudinally and transversely by detachable rail members 7*a* and 7*b* having three openings which are sized so that the rails fit tightly around the lower ends of the cupped feet 5. To keep the number of components at a minimum, it is preferred that the rails extend over the complete length of each line or column in the array. Because each foot 5 has both longitudinal and transverse rails, there are two rail configurations. In the first rail configuration 7*a* the rail extends straight between all of the feet in the column or line and is connected to each foot at ground level. In the second rail configuration 7*b*, the rail is offset from or "stepped down" so that it can be connected to the foot atop the straight rail 7*a* and yet the bearing surface is contiguous with the ground level. Thus the rings of the stepped rails 7*b* are attached first around the feet, after which the rings of the straight rails 7*a* are attached beneath the rings of the stepped rails. The rings from both rails 7*a* and 7*b* are properly positioned around the cupped feet 5 by pressing the rings upwardly into appropriately located circumferential grooves. The rails serve the important function of holding the cupped feet firmly so that they do not undergo spreading under the weight of heavy loads. Such stabilization substantially increases the load carrying capacity of the pallets for a given weight of material. The stepped rail is required so that the forks of a forklift truck can easily and reliably insert between the rail and deck as a load is lifted. Without the step in the rail, the forks could accidentally insert below the rail, thus, causing an unstable load and a safety hazard by which the load and pallet might fall off the forks.

Though the Drawing illustrates the use of circular cupped feet 5, other symmetrical cross sections of four or more sides can be used as well. For example, symmetrical polygons having a multiple of four sides such as squares and octagons can be used. The opening on the rails have like configuration.

In the preferred form of the invention as described above, the load deck 1 is comprised of four modular sections 3. In standard-sized pallets, it is preferred that at least four sections be employed since they are smaller in size and therefore the cost of the necessary injection molding equipment is much less. Nevertheless, standard-size pallets can be made of three or even two modular sections with appropriate configurational changes. Standard pallets comprising four sections are, however, preferred since all the modular sections can be identical, thereby not requiring a multiplicity of expensive molds.

Though it is preferred for the economic reasons outlined above that the deck be comprised of a plurality of modular sections, it will nevertheless be recognized that it is technologically quite feasible to form the deck as a unitary part. That is, the entire deck can be molded as one piece. However, such one piece molded construction of the deck will be, in most instances, more expensive than modular construction.

While it is preferred that the cupped feet be tapered downward, i.e. frustoconical in shape, it will be recognized that they can be cylindrical as well and that snap and groove connections can be used to attach the rail connector rings to the cupped feet. Another advantage of using tapered feet is that they can be nested to save shipping and storage space when the pallet is disassembled.

Furthermore, the cupped feet can have more than one configuration. For example, the sides of the feet can be tapered in the lower end and straight in the upper end or they can be of square cross section in the upper end and of circular cross section in the lower end. Numerous such geometric combinations can be chosen according to the preferred engineering practice and the economics of each combination vis-a-vis the performance requirements of the pallet.

Symmetry of the array of the cupped feet is preferred in order that complete loading access to the pallet can be obtained on all sides. On the other hand, symmetry of the cupped feet is preferred so that the number of separate molded parts can be minimized. In the configuration discussed above and illustrated in FIG. 1, the entire pallet assembly can be assembled entirely from only four different molded shapes. That is, the deck sections are interchangeable as are the cupped feet and the two types of rails. The simplicity of the assembly facilitates disassembly and reassembly without special tools.

It will be recognized by those skilled in the pallet art that the pallets of the invention can be readily designed to obtain special properties and operating convenience. For example, the upper deck surface can be molded to present a roughened surface or coated with adhesive to inhibit sliding movement of loads thereon and the pallet can be molded with appropriate banding slots which eliminate the need for banding clips. In addition, a tongue and groove system can be incorporated to facilitate stretch film wrapping of the loaded pallet. In a still further variation, the perimeter of the deck has an upward extending lip to limit lateral motion of the load. This protruding lip 9 is shown in FIGS. 1, 2, 3, 4, and 7.

Materials of Construction

The pallets of the invention are especially adapted so that they can be made economically from recyclable or recycled polymers. Polymers suitable for use in the invention must be thermoplastic and preferably are water resistant as well. The use of water-resistant polymers is, of course, essential if the pallets are used and/or stored outdoors under conditions by which they are exposed to high humidity and/or precipitation such as rain or snow. In addition, they must be formable by injection molding techniques and thermally stable at injection molding temperatures. Therefore, thermoset polymers and highly cross-linked polymers are not preferred for use in the invention because they are insufficiently thermoplastic to be injection molded.

Polymer classes which meet these criteria include non-crystalline polymers such as polyolefins, polyesters, e.g. poly(ethylene terephthalate), poly(vinyl chloride), ethylene-carbon monoxide copolymers, poly(ether ketones) and nylon, and crystalline polymers such as polystyrene, acrylics and polycarbonates. However, many acrylic polymers are too brittle for this application. Furthermore, elastomers are generally unsuitable since they are usually cross-linked and therefore less thermoplastic. Preferred polymers for use in making the pallets of the invention are polyolefins such as polyethylene, polypropylene and ethylene-propylene copolymers. High density polyethylene and polypropylene are particularly preferred.

In practice, mixtures of polymers can be used so long as they are compatible or compatibilized and so long as they have similar processing temperatures. The polymers will frequently contain a small amount of secondary materials such as inorganic fillers, reinforcing fibers, plasticizers, UV stabilizers, antioxidants and the like.

In order to reduce the weight of the pallet, it is preferred that the pallet components be molded from polymers which have been foamed to reduce the density of the polymeric material.

We claim:

1. A shipping pallet assembly, which may be disassembled to smaller volume for shipping, reassembly and reuse, comprising a rigid substantially planar rectangular deck having an upper load surface and lower support surface, a plurality of open-ended detachable hollow feet having a symmetrical cross section, the lower ends of which are cupped inwardly to form bearing surfaces and the upper ends of which depend from and are attached to the deck through foot attachment openings in the deck in a centrally positioned symmetrical array of lines and columns, each line and column being comprised of at least three such feet in both the longitudinal and transverse directions of the array, the lower end of each of the feet being linked both longitudinally and transversely by a pair of detachable rail members which extend over the entire length and width of the array, each detachable rail member comprising a rigid rail having a plurality of openings spaced along and at the ends thereof to match the number and spacing of the cupped feet within any line or column of the array, the openings in the rails being sized in such manner that the rails fit tightly over the perimeter of the cupped feet at or near the lower end of each of the feet, the deck, feet and rail members all being formed by injection molding of a molten normally solid thermoplastic polymer.

2. The assembly of claim 1 in which the perimeter of the upper load surface of the deck has an upward projecting lip to limit the lateral motion of objects supported on the pallet assembly.

3. The assembly of claim 1 in which the upper load surface is roughened to inhibit sliding motion of objects supported on the pallet assembly.

4. The assembly of claim 1 in which the feet are tapered to facilitate nesting of the support feet when the rails between the feet are detached.

5. The assembly of claim 1 in which the feet are annular in cross section.

6. The assembly of claim 1 in which the array is comprised of nine feet in a square configuration.

7. The assembly of claim 1 in which the deck contains a pattern of perforations to reduce the weight of the assembly.

8. The assembly of claim 1 in which the feet are affixed to the deck by means of a bayonet-type connection, the complementary components of which are molded into the periphery of the feet and the inside surface of the foot attachment openings in the deck.

9. The assembly of claim 1 in which the rails connecting the feet in one direction of the array are stepped rails and the rails connecting feet in the transverse direction of the array are straight rails, the stepped rail member being atop the straight rail member, both being positioned on the periphery of the cupped feet so that the lower surface of the rails and the cupped end of the feet are load-bearing when the pallet assembly is placed on a planar surface.

10. The assembly of claim 9 in which the rail members are positioned on the cupped feet by means of a snap-fit connection.

11. The assembly of claim 1 in which the thermoplastic polymer is a polyolefin selected from polyethylene, polypropylene, ethylene-propylene copolymer and mixtures thereof.

12. The assembly of claim 1 in which the molten polymer contains a small amount of inorganic filler.

13. The assembly of claim 1 in which the molten polymer contains an effective amount of UV stabilizer.

14. The assembly of claim 1 in which the molten polymer has been foamed with an inert gas to reduce the density of the molded polymer.

15. The assembly of claim 1 in which the deck is formed from rectangular interlocking sections having a substantially identical configuration.

16. The assembly of claim 15 in which the sections are interlocked by means of an interlocking lap joint.

17. The assembly of claim 16 in which a plurality of the foot attachment openings are located across joints between two or more interlocking sections by which attachment of the cupped feet to the deck also serves to interlock the interlocking sections.

* * * * *